United States Patent [19]

Gillbrand

[11] Patent Number: 4,484,445

[45] Date of Patent: Nov. 27, 1984

[54] ARRANGEMENT FOR CONTROLLING EXHAUST GAS RECIRCULATION IN A SUPERCHARGED INTERNAL COMBUSTION ENGINE

[75] Inventor: Per S. Gillbrand, Enhörna, Sweden

[73] Assignee: Saab-Scania Aktiebolag, Sodertalje, Sweden

[21] Appl. No.: 541,660

[22] Filed: Oct. 13, 1983

[30] Foreign Application Priority Data

Oct. 15, 1982 [SE] Sweden ..... 8205854

[51] Int. Cl.[3] ..... F02B 37/00; F02M 25/06

[52] U.S. Cl. ..... 60/605; 60/602; 123/568; 123/569

[58] Field of Search ..... 60/602, 605; 123/569, 123/571, 568

[56] References Cited

U.S. PATENT DOCUMENTS

| | | | |
|---|---|---|---|
| 3,925,989 | 12/1975 | Pustelnik | 60/602 |
| 4,083,188 | 4/1978 | Kumm | 60/605 |
| 4,142,494 | 3/1979 | Negri et al. | 60/605 |
| 4,214,562 | 7/1980 | Mowbray | 123/568 |
| 4,246,752 | 1/1981 | Tryon | 60/605 |
| 4,249,382 | 2/1981 | Evans et al. | 123/571 |
| 4,336,688 | 6/1982 | Dellis | 60/602 |
| 4,349,004 | 9/1982 | Matsuda | 123/569 |
| 4,350,013 | 9/1982 | Yoshiba | 123/569 |

FOREIGN PATENT DOCUMENTS

| | | | |
|---|---|---|---|
| 55-93950 | 7/1980 | Japan | 123/571 |
| 56-129747 | 10/1981 | Japan | 123/509 |
| 57-148027 | 9/1982 | Japan | 60/602 |
| 630936 | 10/1949 | United Kingdom | 60/602 |

*Primary Examiner*—Wendell E. Burns

*Attorney, Agent, or Firm*—Cushman, Darby & Cushman

[57] ABSTRACT

An arrangement for exhaust gas recirculation in a supercharged internal combustion engine has an intake system and an exhaust system joined to each other via a conduit for recirculating exhaust gases to an intake conduit. This recirculation is controlled by a valve in response to the engine intake pressure, said valve having control means comprising an outer and an inner chamber separated by a movable membrane attached to which is a valve member regulating the flow through the conduit. Said valve member is acted on via the membrane by a spring in the outer chamber, which chamber is connected via a conduit to the intake conduit immediately upstream of the idle position for a throttle valve pivotably mounted in the intake conduit. The inner chamber is connected via a conduit to the intake conduit upstream of the connection of the conduit from the outer chamber but downstream of a compressor of the intake system. A certain overpressure in the inner chamber relative to the outer chamber, the force exerted by the spring on the membrane will be overcome and cause the valve spindle to open the conduit.

5 Claims, 1 Drawing Figure

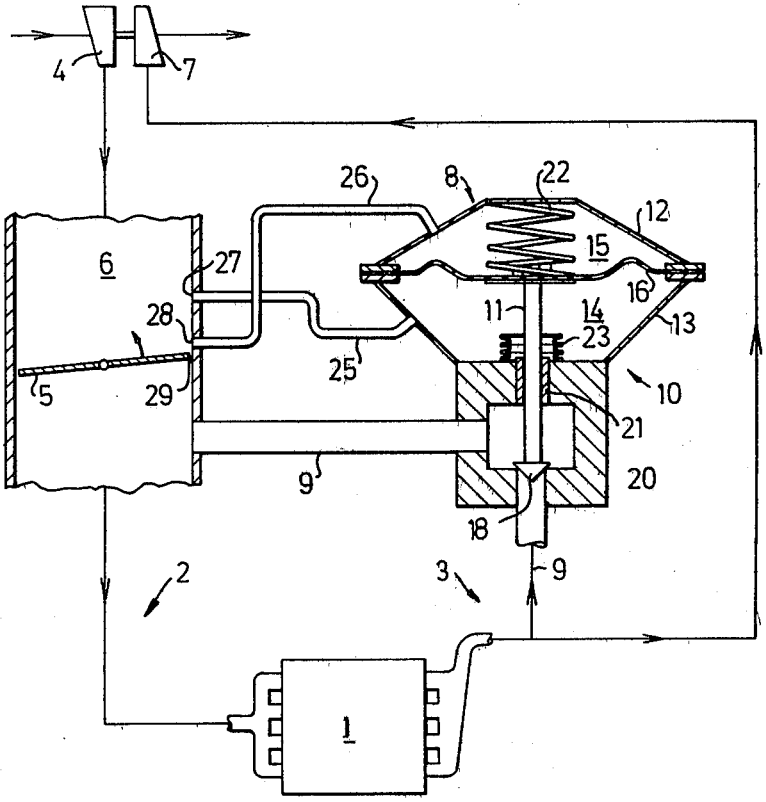
4
7
26
8
22
12
6
27
15
16
28
11
14
13
23
25
5
29
10
21
9
20
18
2
3
9
1

ARRANGEMENT FOR CONTROLLING EXHAUST GAS RECIRCULATION IN A SUPERCHARGED INTERNAL COMBUSTION ENGINE

The present invention relates to an arrangement for controlling exhaust gas recirculation (EGR) in a supercharged internal combustion engine equipped with an intake system and an exhaust system and between said systems a conduit arranged for recirculating exhaust gases to an intake conduit in the engine intake system, the exhaust recirculation being controlled by a valve under the influence of the engine intake pressure and at least one spring arranged in the control means.

In vehicle engines where there is always atmospheric pressure or subatmospheric pressure in the engine intake system, i.e. in so-called suction engines, it is previously known to use exhaust gas recirculation for the purpose of achieving cleaner exhaust emissions. In such a known arrangement a valve regulating the recirculation of exhaust gases is controlled by a control means, in which a membrane separates an inner chamber and an outer chamber. The inner chamber communicates directly with the surrounding air, and therefore there is always atmospheric pressure in this chamber. At idle and full load, there is transmitted from the intake system to the outer chamber a pressure which is only slightly lower than atmospheric pressure. A spring arranged in the outer chamber is then able to push the membrane separating the chambers and a valve means connected thereto to a closed valve position in which the recirculation of exhaust gases ceases. At partial load however, the subatmospheric pressure in the intake system overcomes the spring force and opens the valve to recirculate exhaust gases to the intake system.

It is however not possible to apply this known arrangement to a supercharged internal combustion engine since, under the majority of operating conditions, there is overpressure in the intake system downstream of a compressor in a supercharging unit.

In other known solutions for EGR control in suction engines, the subatmospheric pressure from two pressure outlets disposed above one another in the intake system is used. The two outlets are disposed immediately upstream of the idle position for a throttle valve arranged in the intake system. In arrangements according to the Swedish Patent Specification No. SE 388 668 and the U.S. Pat. No. 4,144,856 the outlets are for example each connected to an individual EGR valve, which in both cases require subatmospheric pressure to control the amount of exhaust, also called "the EGR amount".

This is also the case in an arrangement according to German Patent Specification No. 25 49 959. An EGR valve of double membrane type is arranged to control the EGR amount in response to the pressure in two pressure outlets disposed in the intake system as described above.

Thus the above-mentioned known solutions cannot be immediately applied to supercharged internal combustion engines in which overpressure must control the EGR valve.

The present invention relates to an arrangement which in a simple manner makes it possible to control the exhaust gas recirculation in a supercharged internal combustion engine of the type described in the introduction to the description. The exhaust gas recirculation is controlled by a valve comprising a slidably mounted valve spindle which cooperates with a membrane in a control means. The membrane separates an outer chamber and an inner chamber and is arranged to become axially displaced by the engine intake pressure and at least one spring or the like arranged in the control means, the outer chamber in the control means being connected by a conduit to the intake conduit immediately upstream of the idle position for a throttle valve pivotably mounted in the intake conduit. The invention is characterized in that the inner chamber is connected via a conduit to the intake conduit upstream of the conduit connection from the outer chamber but downstream of a compressor included in the intake system whereby, when there is a certain overpressure in the inner chamber relative to the outer chamber, the force exerted on the membrane by the spring can be overcome and thereby cause the valve spindle to open the conduit.

The inventive arrangement makes it possible to modify an EGR valve known from suction engines to include a second sealed chamber which is connected to the intake system in the above-stated manner. The valve will thus control the EGR amount only in response to the pressure differential between the connections in the intake conduit. If both chambers are supplied with overpressure, this will make no difference for the functioning of the EGR valve.

Other features characterizing in the invention are revealed in the accompanying patent claims and in the description below of an embodiment exemplifying the invention, with reference to an accompanying figure which illustrates schematically the inventive arrangement.

The FIGURE shows schematically an Otto engine 1 which is designed to be supplied with a fuel-air mixture via an intake system 2 and from which engine exhaust gases are led off via an exhaust system 3. The intake system 2 comprises a centrifugal compressor 4 which under operating conditions can produce an overpressure in an intake conduit 6 located downstream thereof. In said intake conduit 6 there is pivotably mounted a throttle valve 5 operable by the driver, whereby the driver can regulate the fuel-air mixture supplied to the engine 1. The fuel can be supplied to the intake system 2 either via carburettors or via injection nozzles (not shown).

The exhaust system 3 comprises an exhaust turbine 7 driven by the exhaust gases. This turbine drives in turn the compressor 4 via a shaft common to both the turbine 7 and the compressor 4. A certain amount of exhaust gases can be recirculated to the intake conduit 6 via a conduit 9 which is arranged to cooperate with a control valve 10, hereinafter called the EGR valve.

Said EGR valve 10 comprises a control means 8 and a valve housing 20 securely joined to each other. The control means 8 consists of two housing halves 12,13 between which a membrane is held along the periphery thereof, thus separating an inner chamber 14 and an outer chamber 15. A valve member in the form of a valve spindle 11 is fixed at one end to the central portion of the membrane 16, and the free end thereof is in the form of a valve disc 18 which cooperates with an inner valve seat in the valve housing 20 at a position corresponding to one connection of the conduit 9 to the valve housing 20. The valve spindle 11 is mounted in the valve housing 20 by means of a bushing 21. A sealing bellows 23 is arranged to prevent exhaust gases from penetrating into the inner chamber 14 of the control means 8 via the mounting of the valve spindle 17 in the bushing 21. A helical spring 22 arranged in the outer chamber 15 between the housing wall 12 and the membrane 16 urges the membrane 16 and thus the valve spindle 11 towards the valve seat.

The outer chamber 15 is connected via a conduit 26 to the intake conduit 6 via a connection 28 immediately upstream of the throttle valve 5 idle position, which is the throttle position shown in the FIGURE. Via a conduit 25 the inner chamber 14 is connected to the intake conduit 6 at a connection 27 located upstream of the conduit 26 connection 28 but within the pivoting range of the throttle valve 5. The position of the connection 28 relative to the idle position of the throttle valve 5 determines at what engine load, i.e. at what intake pressure, the EGR valve 10 will open for recirculating exhaust gases to the intake conduit 6. In supercharged Otto engines said engine load should correspond to an absolute pressure which exceeds approximately 0.3 bar (0.03 MPa), suitably 0.4 bar (0.04 MPa) in the intake conduit 6 downstream of the throttle valve. In such an engine with a cylinder volume of about 2 $dm^3$, this pressure is obtained when the throttle valve 5 edge facing the connections 27,28 has a distance to the connection 28 in the idle position of about 3.5 mm from center to center. In such a case the throttle valve 5 can be rotated from the idle position about 10 degrees before its edge 29 assumes a position directly in front of the connection 28.

The upper connection 27 is placed relative to the connection 28 so that, at an engine load corresponding to an absolute pressure of about 1.4 bar (0.14 MPa) to 1.5 bar (0.15 MPa) in the intake conduit 6 downstream of the throttle valve 5, the two connections 27,28 transmit essentially the same pressure level to the chambers 14,15. This means that the EGR valve 10, under the influence of the spring 22, is closed and that no exhaust gas recirculation takes place. In a supercharged Otto engine, this is achieved when the connection 27 transmits essentially the same pressure to the inner chamber 14 as the pressure prevailing upstream of the throttle valve 5. Such a transmission occurs when the throttle valve 5 has been turned at least about 40–50 degrees from the connection 28. Upon further rotation of the throttle valve 5 there will be a higher intake pressure than about 1.4–1.5 bar (0.14–0.15 MPa), and the connections 27,28 will be at the same pressure level, thus holding the EGR valve 10 closed.

The functioning of the arrangement according to the invention in the operational situations occurring in a vehicle engine can be summarized as follows. At idle and engine braking, the throttle valve 5 will assume the maximum throttled position shown in the FIGURE. At both of the connections 27,28 there will prevail essentially atmospheric pressure, which will consequently also prevail on both sides of the membrane 16. The spring 22 can thus via the membrane 16 press the valve spindle 11 and the valve disc 18 to seat against the valve seat in the valve housing 20. The valve 10 thus closes the passage through the conduit 9 and prevents the recirculation of exhaust gases to the intake system 6.

If the throttle 5 is rotated about 10 degrees from the idle position, a position corresponding to low engine load is obtained whereby the valve edge 29 is located essentially directly in front of the connection 28. In this position, the outer chamber 15 is supplied with a lower pressure via the connection 28 than the pressure supplied to the inner chamber 14 via its corresponding connection 27. There will thus arise a pressure differential over the membrane 16, and this differential can rise relatively rapidly to about 0.4–0.6 bar (0.04–0.06 MPa). This pressure differential opposes the force of the spring 22. At a pressure differential of about 0.1 bar (0.01 MPa), the membrane 16 is able to overcome the spring force so that the valve 10 opens, and exhaust gases can be transmitted to the intake system 2 via the conduit 9.

Regardless of whether there is subatmospheric pressure or overpressure in the connections 27,28, the valve 10 will be kept open under increased engine load in a partial load range corresponding to rotation of the throttle valve 5 in the sector between said connections 27,28. After turning about 45 degrees from the position directly in front of the connection 28, the pressures at the two connections 27,28 are again balanced out, and the pressure differential over the membrane 16 disappears. The spring 22 then closes the valve 10 and the exhaust gas recirculation through the conduit ceases. Continued increase of the engine load to full load, i.e. continued rotation of the throttle valve 5 towards a minimum throttle, full load position, results in a similar rise in pressure level at the two connections 27,28 without giving rise to any pressure differential capable of opening the EGR valve. Consequently, the EGR valve 10 is held closed in said full load range.

The invention is not restricted to the embodiment described here but can be modified within the scope of the following patent claims in a number of embodiments for the purpose of achieving exhaust gas recirculation in an internal combustion engine equipped with a supercharger regardless of whether there is subatmospheric pressure or overpressure in the intake system. The connection between the intake conduit 6 and the inner chamber 14 of the control means 8 enables the EGR valve 10 to be kept open as long as there is a pressure drop over the throttle valve 5, even if the pressure in the intake conduit 6 rises above atmospheric pressure. At full load without a pressure drop over the throttle valve 6, the EGR valve 10 is closed with the aid of the spring 22 in the control means 8.

The arrangement according to the invention makes exhaust gas recirculation possible within a relatively broad load range, and this is especially desirable in recently developed fuel-saving engines with relatively rapid combustion. Increased mixing-in of exhaust gases in the fuel-air mixture supplied to such an engine not only reduces the content of nitrogen oxides in the engine exhaust but also contributes to an increased thermal efficiency, i.e. lower fuel consumption as long as the mixing-in of exhaust does not exceed a certain highest level. More even and therefore quieter combustion is also obtained in the engine combustion chambers.

What I claim is:

1. Arrangement for controlling exhaust gas recirculation (EGR) in a supercharged internal combustion engine equipped with an intake system and an exhaust system and between said systems a conduit arranged for recirculating exhaust gases to an intake conduit in the engine intake system, the exhaust gas recirculation being controlled by a valve comprising a slidably mounted valve spindle which cooperates with a membrane in a control means in which the membrane separates an outer chamber and an inner chamber and is disposed to become axially displaced under the influence of the engine intake pressure and at least one spring or the like arranged in the control means, said outer chamber in the control means being connected via a conduit to the intake conduit immediately upstream of the idle position for a throttle valve pivotably mounted in the intake conduit, characterized in that the inner chamber is connected via a conduit to the intake conduit upstream of the connection of the conduit from the outer chamber but downstream of a compressor of the intake system whereby, at a certain overpressure in the inner chamber relative to the outer chamber, the force exerted by the spring on the membrane can be overcome and thus cause the valve spindle to open the conduit for recirculating exhaust gases.

2. Arrangement according to claim 1, characterized in that the connection of the conduit to the intake conduit is located within a rotation range of the throttle valve of less than 45 degrees.

3. Arrangement according to claim 1, characterized in that the connection of the conduit to the intake conduit is placed so that upon turning the throttle valve from the idle position to a position opposite the connection, different pressures will arise in the connections only when the pressure in the intake conduit downstream of the throttle valve exceeds about 0.3 bar (0.03 MPa).

4. Arrangement according to claim 3, characterized in that the connection of the conduit to the intake conduit is located so that upon turning the throttle valve between the connections, different pressures will prevail at the connections as long as the inlet pressure downstream of the throttle valve is at most about 1.5 bar (0.05 MPa).

5. Arrangement according to claim 4, characterized in that the connections are located so that upon turning the throttle valve from the idle position, different pressures will prevail at the connections as long as the intake pressure downstream of the throttle valve is about 0.4–1.4 bar (0.04–0.14 MPa).

* * * * *